US009358421B2

(12) United States Patent
Mercenari Uribe

(10) Patent No.: US 9,358,421 B2
(45) Date of Patent: Jun. 7, 2016

(54) INTEGRAL VERTICAL STEPPER

(71) Applicant: Fernando Humberto Mercenari Uribe, Mexico (MX)

(72) Inventor: Fernando Humberto Mercenari Uribe, Mexico (MX)

( * ) Notice: Subject to any disclaimer, the term of this patent is extended or adjusted under 35 U.S.C. 154(b) by 0 days.

(21) Appl. No.: 14/732,077

(22) Filed: Jun. 5, 2015

(65) Prior Publication Data

US 2015/0343259 A1 Dec. 3, 2015

Related U.S. Application Data

(63) Continuation of application No. PCT/MX2013/000186, filed on Dec. 18, 2013.

(30) Foreign Application Priority Data

Mar. 11, 2013 (MX) ..... MX/u/2013/000125

(51) Int. Cl.

| | |
|---|---|
| ***A63B 23/04*** | (2006.01) |
| ***A63B 22/04*** | (2006.01) |
| ***A63B 21/00*** | (2006.01) |
| ***A63B 21/018*** | (2006.01) |
| ***A63B 22/00*** | (2006.01) |
| ***A63B 22/20*** | (2006.01) |
| ***A63B 23/035*** | (2006.01) |

(52) U.S. Cl.

CPC ..... *A63B 22/04* (2013.01); *A63B 21/018* (2013.01); *A63B 21/1465* (2013.01); *A63B 21/1488* (2013.01); *A63B 22/001* (2013.01); *A63B 22/0066* (2015.10); *A63B 22/205* (2013.01); *A63B 23/03516* (2013.01); *A63B 23/03583* (2013.01); *A63B 23/04* (2013.01); *A63B 2022/0043* (2013.01)

(58) Field of Classification Search

USPC ..... 482/1–148

See application file for complete search history.

(56) References Cited

U.S. PATENT DOCUMENTS

| | | | | |
|---|---|---|---|---|
| 4,958,830 | A * | 9/1990 | Huggins | A61H 1/0259 482/51 |
| 5,000,441 | A * | 3/1991 | Wang | A63B 22/0002 482/112 |
| 5,011,136 | A * | 4/1991 | Rennex | A63B 69/0028 482/51 |
| 5,090,690 | A * | 2/1992 | Huang | A63B 22/0002 482/131 |
| 5,222,927 | A | 6/1993 | Chang | |
| 6,099,439 | A | 8/2000 | Ryan et al. | |
| 6,390,956 | B1 * | 5/2002 | Seelye | A63B 25/08 482/128 |

(Continued)

FOREIGN PATENT DOCUMENTS

| | | | |
|---|---|---|---|
| EP | 1834674 | A2 | 9/2007 |
| JP | 2011058636 | A | 3/2011 |

*Primary Examiner* — Stephen Crow

(74) *Attorney, Agent, or Firm* — Baker & Hostetler LLP

(57) ABSTRACT

The integral vertical stepper is comprised by a mechanical system intended to generate a dependent and coordinated ascent and descent constant movement, sliding on an upright structure that holds the pedal system, and this in turn supports the two square profiles utilized as handles, thus achieving that all the elements work in a coordinate way, due that it unifies all its constituent elements, with the only purpose of giving stability, support and motor coordination when performing the exercises and routines proposed, thus avoiding risks and possible accidents. Also, said mechanical system is characterized by its simplicity in the design and its functional features, due that all its constituent parts are designed to carry out the adequate functions, i.e., a metal wire coated with a plastic layer, a pulley, a pedal system, two parallel rectangular profiles, two square profiles used as handles, two rails and three wheels.

20 Claims, 11 Drawing Sheets

(56) References Cited

U.S. PATENT DOCUMENTS 6,503,177 B2 * 1/2003 Herman ..... A63B 25/08 482/121
7,448,987 B2 * 11/2008 Arginsky ..... A63B 25/08 482/112
7,686,744 B2 * 3/2010 Middleton ..... A63B 21/0004 482/121
8,118,716 B2 * 2/2012 Grossman ..... A63B 25/08 482/77
2003/0027689 A1 * 2/2003 Chien ..... A63B 25/08 482/23
2006/0160670 A1 * 7/2006 Spencer ..... A63B 25/08 482/77
2013/0210587 A1 * 8/2013 Shank ..... A63B 25/08 482/77

* cited by examiner

INTEGRAL VERTICAL STEPPER

CROSS REFERENCE TO PRIOR APPLICATIONS

This application is a continuation of International Application No. PCT/MX2013/000186, filed Dec. 18, 2013 and designating the U.S., which claims priority to Mexican Patent Application No. MX/u/2013/000125, filed Mar. 11, 2013, both of which are incorporated herein by reference in their entirety.

TECHNICAL FIELD

Sports (Fitness).

BACKGROUND OF THE INVENTION

Countless apparatuses are known for exercising and improving physical condition by practicing routines and diverse types of workouts, without the need of being an expert or a professional athlete. Today, different models of vertical steppers exist, all of them provided with different mechanisms integrated by various dependent and independent systems composed of chains, springs, or pulleys.

The displacement of this mechanical systems sometimes does not allow the body movement to be constant, because they do not generate a uniform ascent and descent, stability, support and much less the individual's motor coordination, causing the user to feel unsafe and uncomfortable when exercising, and therefore quickly loses the interest and confidence when uses this type of apparatuses.

The integral vertical stepper solves the aforementioned problems to full satisfaction, for which focuses its technical features in the fact that its constituent elements integrate a mechanical system composed of a metal wire coated with a plastic layer that when comes in contact with the pulley generates the appropriate friction so that when any person intends to use it can generate the sufficient force for the pedal system. The two vertical poles and the two handles work dependently, guided by two rails and displaced by nine wheels, generating a uniform ascent and descent movement in the stepper, providing stability, support and motor coordination when exercising.

To that end, when designing the integral vertical stepper it also was conceived to be manufactured with the appropriate materials and finishes, in order to obtain technical advantages.

To complement this description and with the aim to ease a better understanding of the technical features of the invention, this description is accompanied as integral part thereof by drawings in which the following has been represented with illustrative and not limitative character.

SUMMARY OF THE INVENTION

The present invention relates to an integral vertical stepper that is specifically used to develop the physical abilities and skills necessary for health and the sport activity, which consists of a system having a pulley, a wire, two rails, a pedal system, nine wheels, two vertical poles and four handles, all of them supported by a triangle-shaped metal structure when it is open, thus allowing a uniform displacement of the mechanism. The stepper provides stability, support and motor coordination when exercising.

DESCRIPTION OF THE INVENTION

Figure 1:
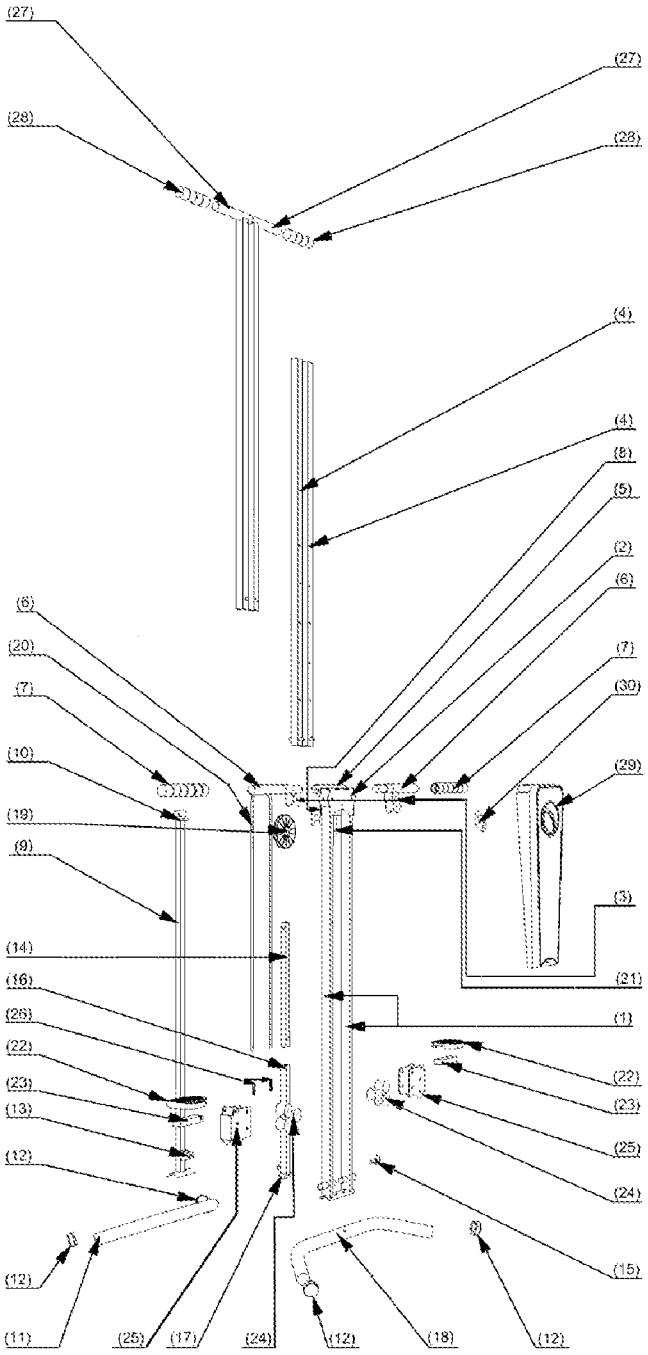
FIG. 1 shows an exploded view of the integral vertical stepper, which displays all the constituent parts of the present invention, a total of thirty (30) parts, which for better understanding are subdivided in FIGS. 1*a*, 1*b*, and 1*c*.
Figure 1A:
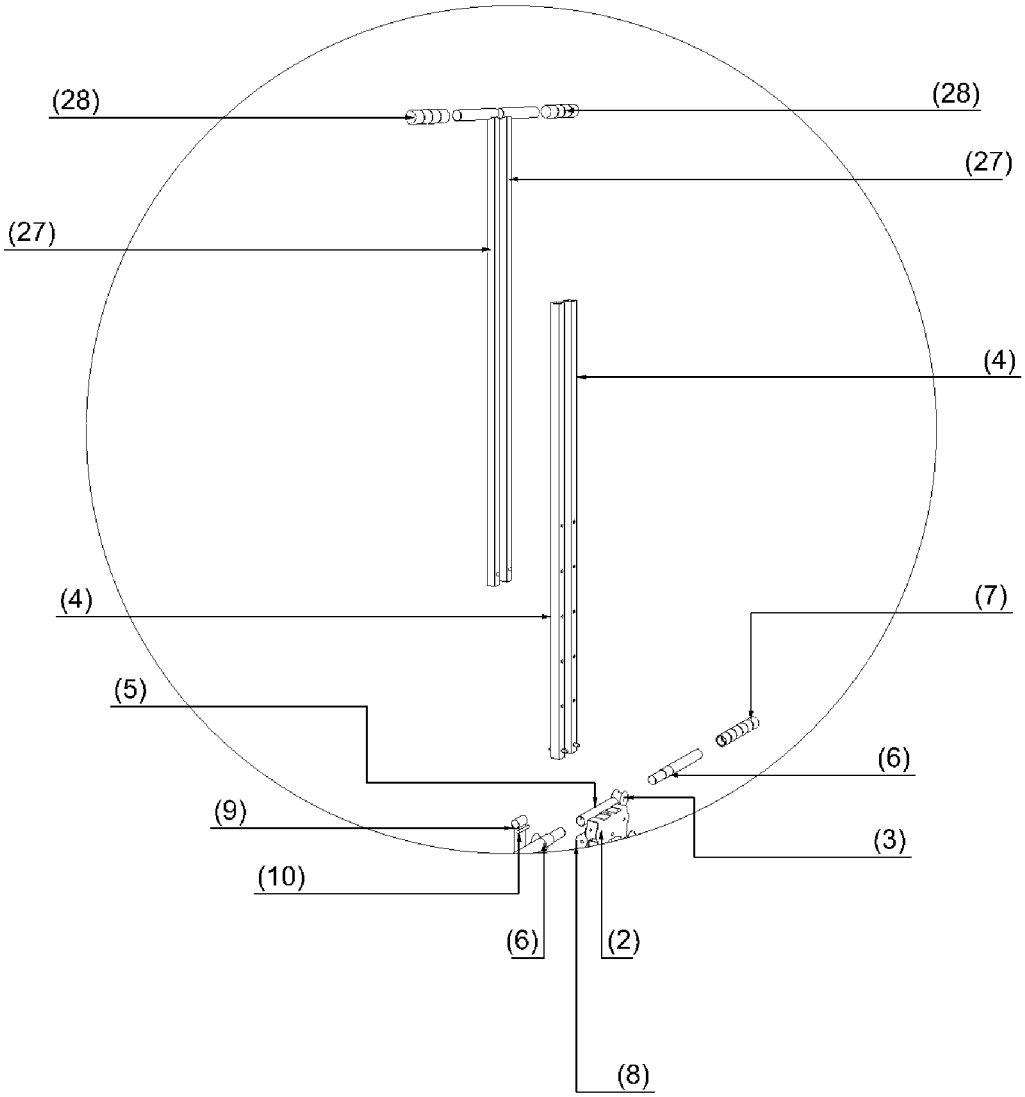
FIG. 1*a* shows the elements present in the first third located from top to bottom of the integral vertical stepper for a better appreciation and understanding of the technical features of the invention.
Figure 1B:
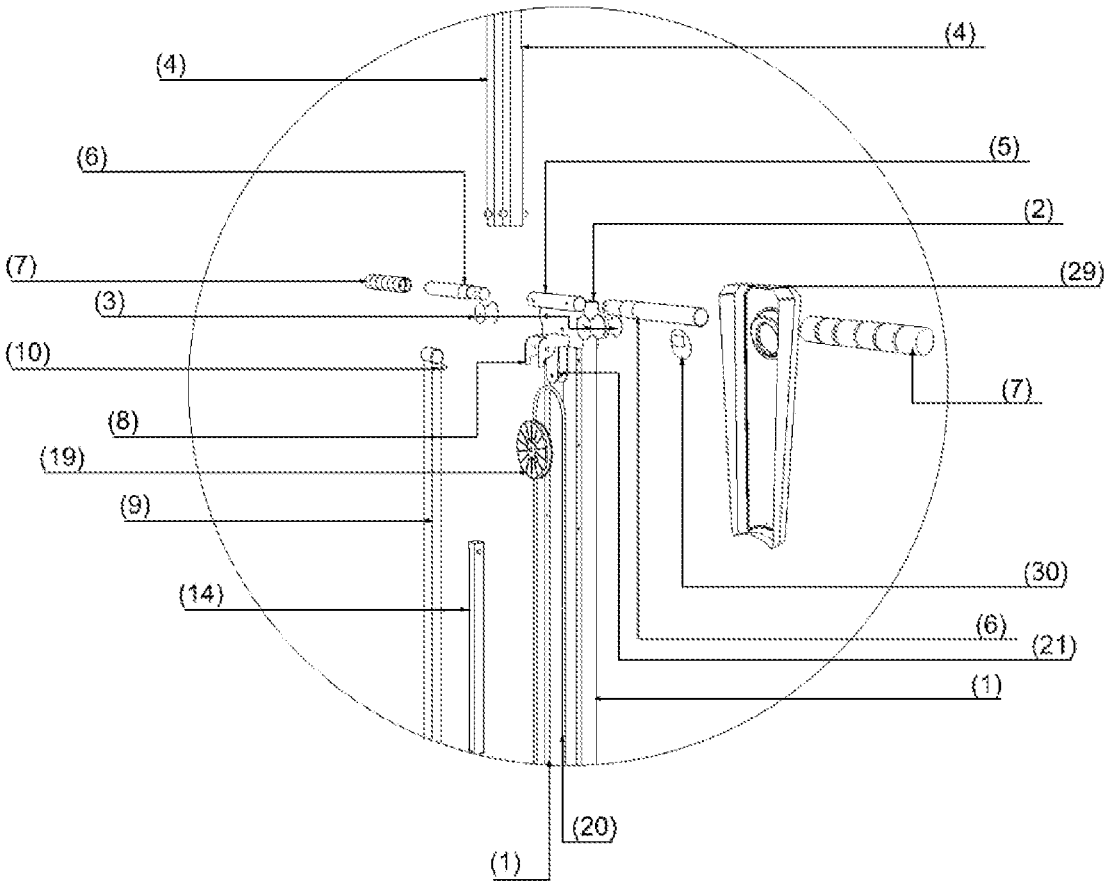
FIG. 1*b* shows the elements present in the second third located from top to bottom of the integral vertical stepper for a better appreciation and understanding of the technical features of the invention.
Figure 1C:
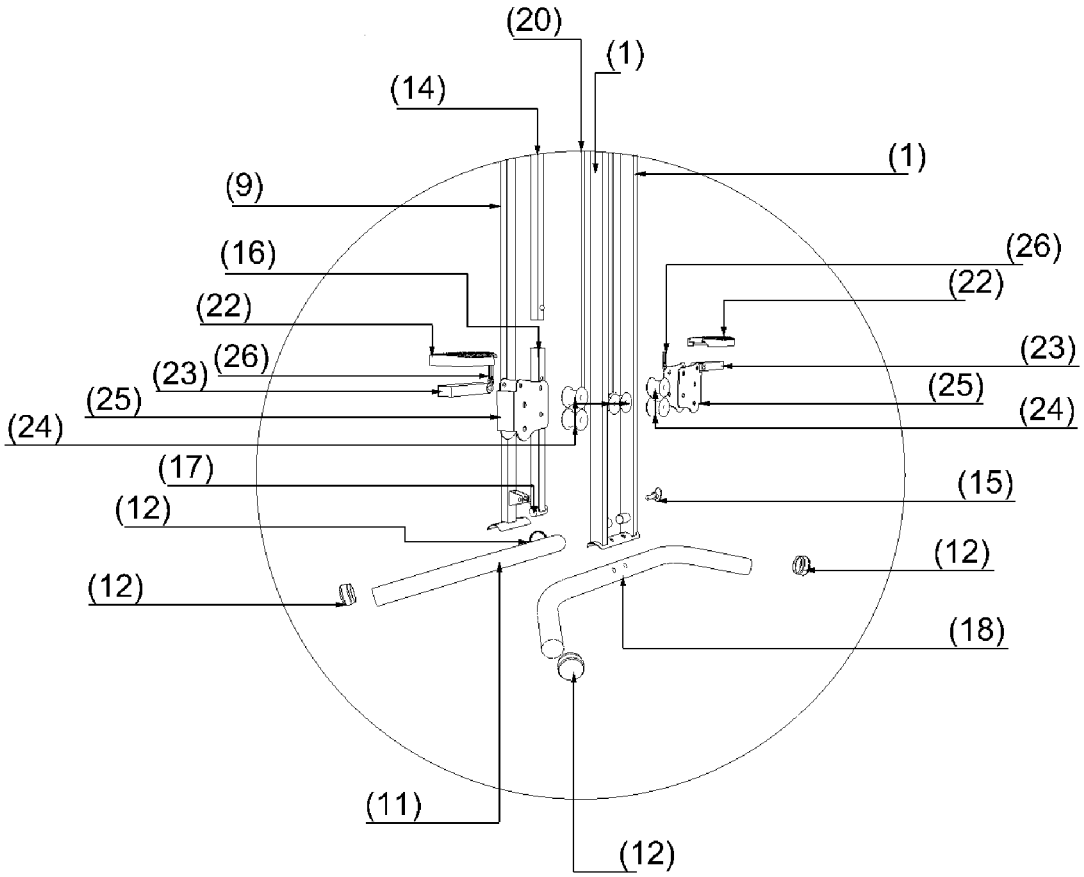
FIG. 1*c* shows the elements present in the last third located from top to bottom of the integral vertical stepper for a better appreciation and understanding of the technical features of the invention.
Figure 2:
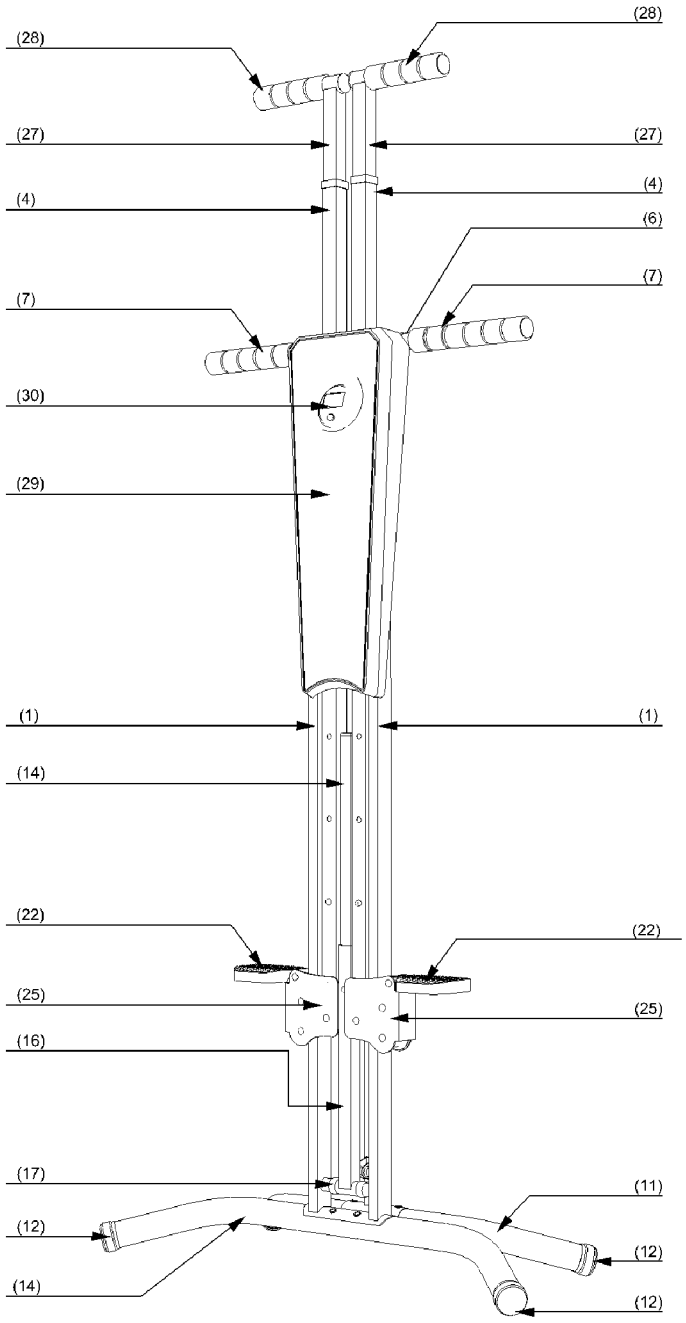
FIG. 2 shows a perspective view of the frontal face of the integral vertical stepper, which displays twenty-five (25) parts of the present invention, taking into account those that were placed symmetrically, which can be seen from this position.
Figure 3:
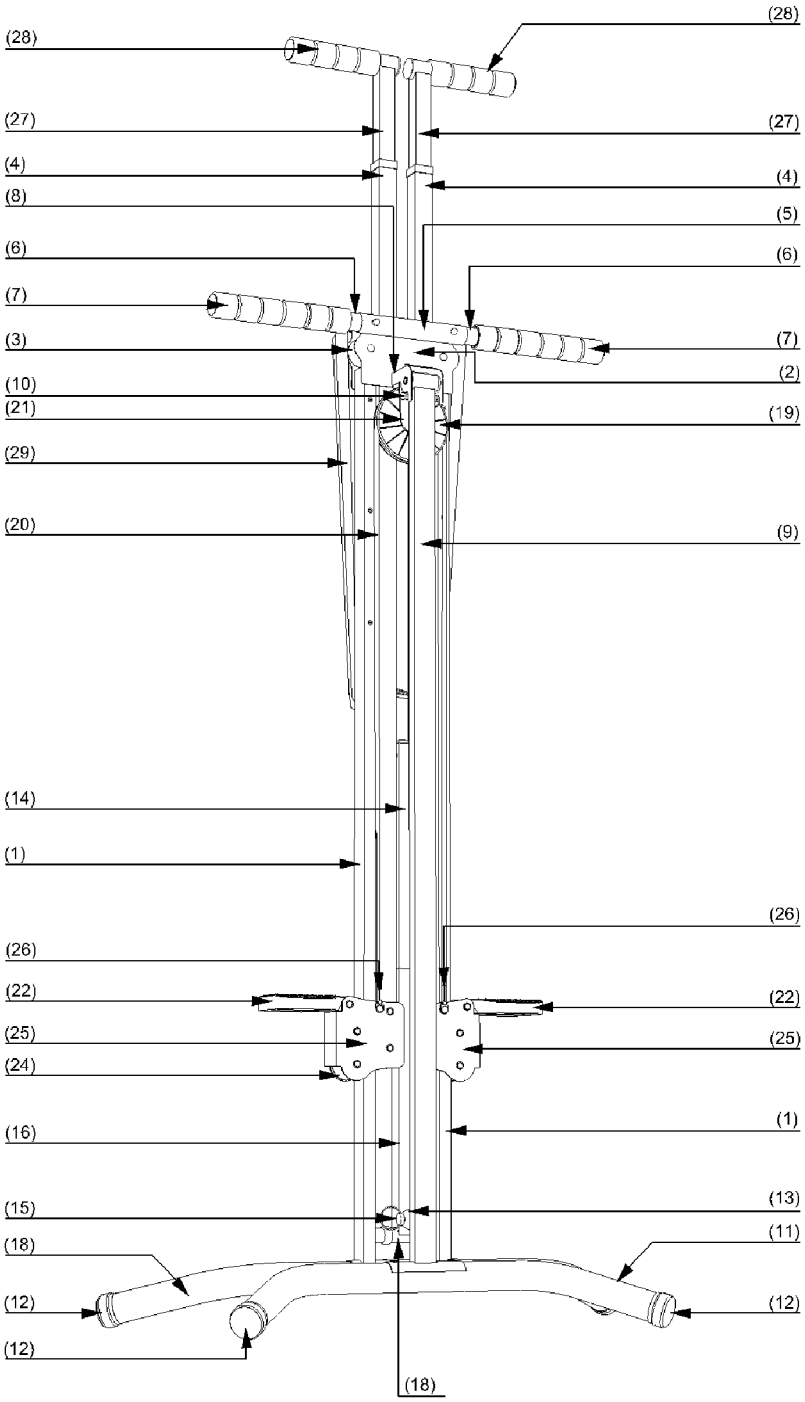
FIG. 3 shows a perspective view of the rear face of the integral vertical stepper, which displays thirty-nine (39) parts of the present invention, taking into account those that were placed symmetrically, which can be seen from this position.
Figures 4, 4A, 4B:
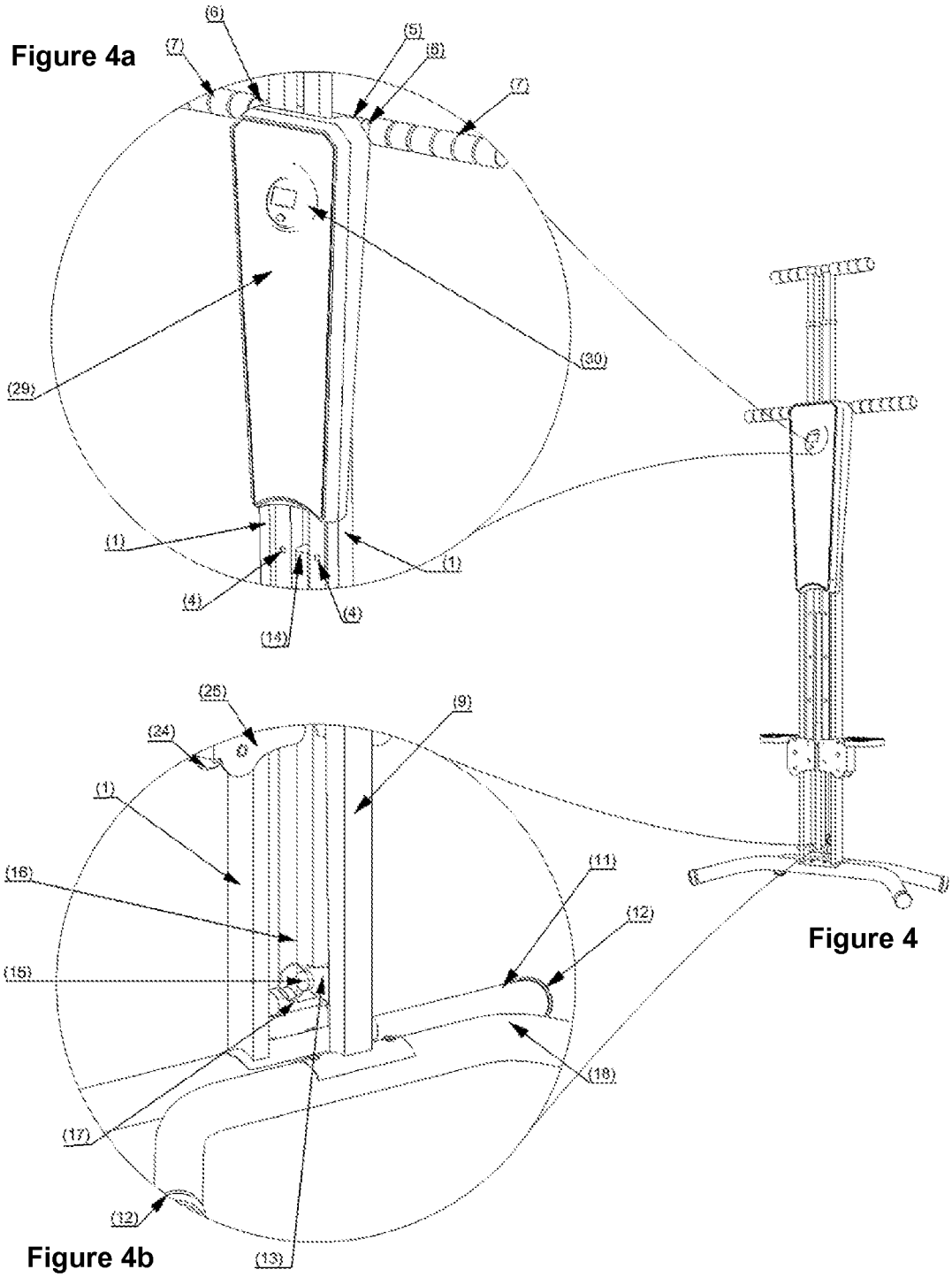
FIG. 4 shows a perspective view with details of the frontal face of the integral vertical stepper, showing the enlarged view of areas with greater number of parts for better illustration of the same, and is subdivided in FIG. 4*a* and FIG. 4*b*.
FIG. 4*a* shows frontally the twelve (12) parts that constitute the second part of the integral vertical stepper, same that already were identified in FIG. 1*b*.
FIG. 4*b* shows frontally the twelve (12) parts that constitute the third part of the integral vertical stepper, same that already were identified in FIG. 1*b*.
Figures 5, 5A, 5B:
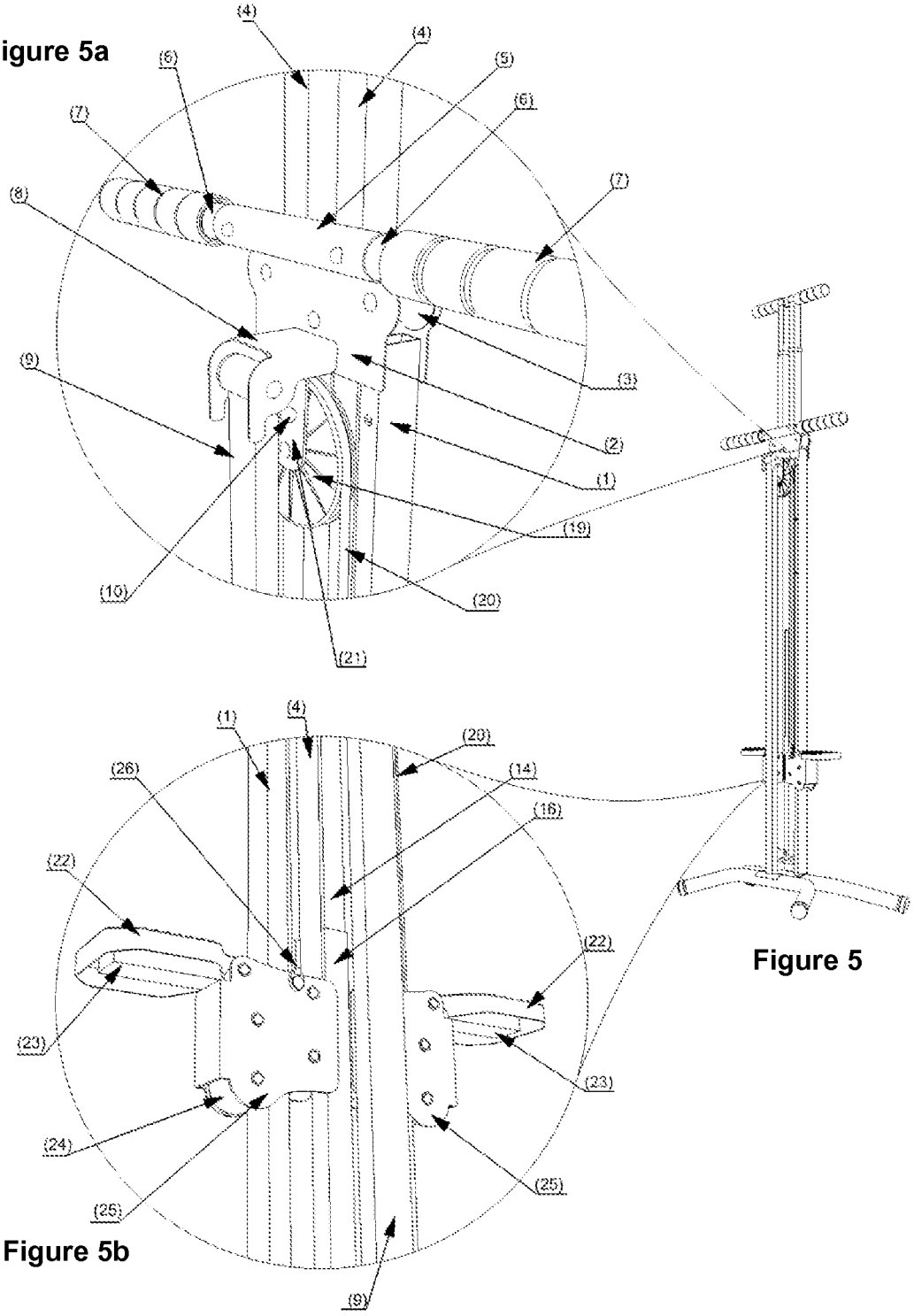
FIG. 5 shows a perspective view with details of the rear face of the integral vertical stepper, showing the enlarged view of areas with greater number of parts for better illustration of the same, and is subdivided in FIG. 5*a* and FIG. 5*b*.
FIG. 5*a* shows in rear view the sixteen (16) parts that integrate the second part of the integral vertical stepper, same that already were identified in FIG. 1*b*.
FIG. 5*b* shows in rear view the fourteen (14) parts that integrate the third part of the integral vertical stepper, same that already were identified in FIG. 1*c*.
Figure 6:
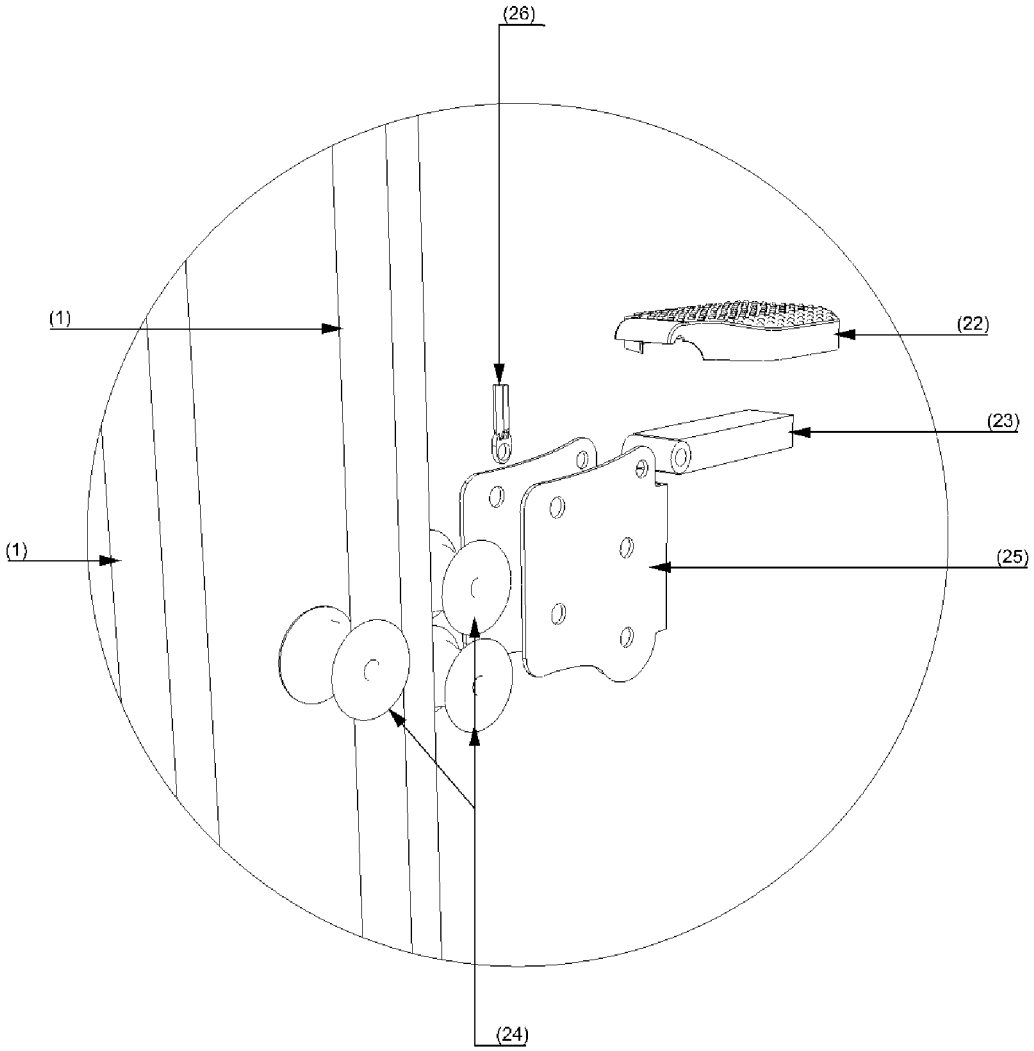
FIG. 6 shows an exploded view of the pedal system of the integral vertical stepper, in which can be seen the proper arrangement of all the parts that integrate this system, which is essential to understand the technical features of said invention.
Figure 7:
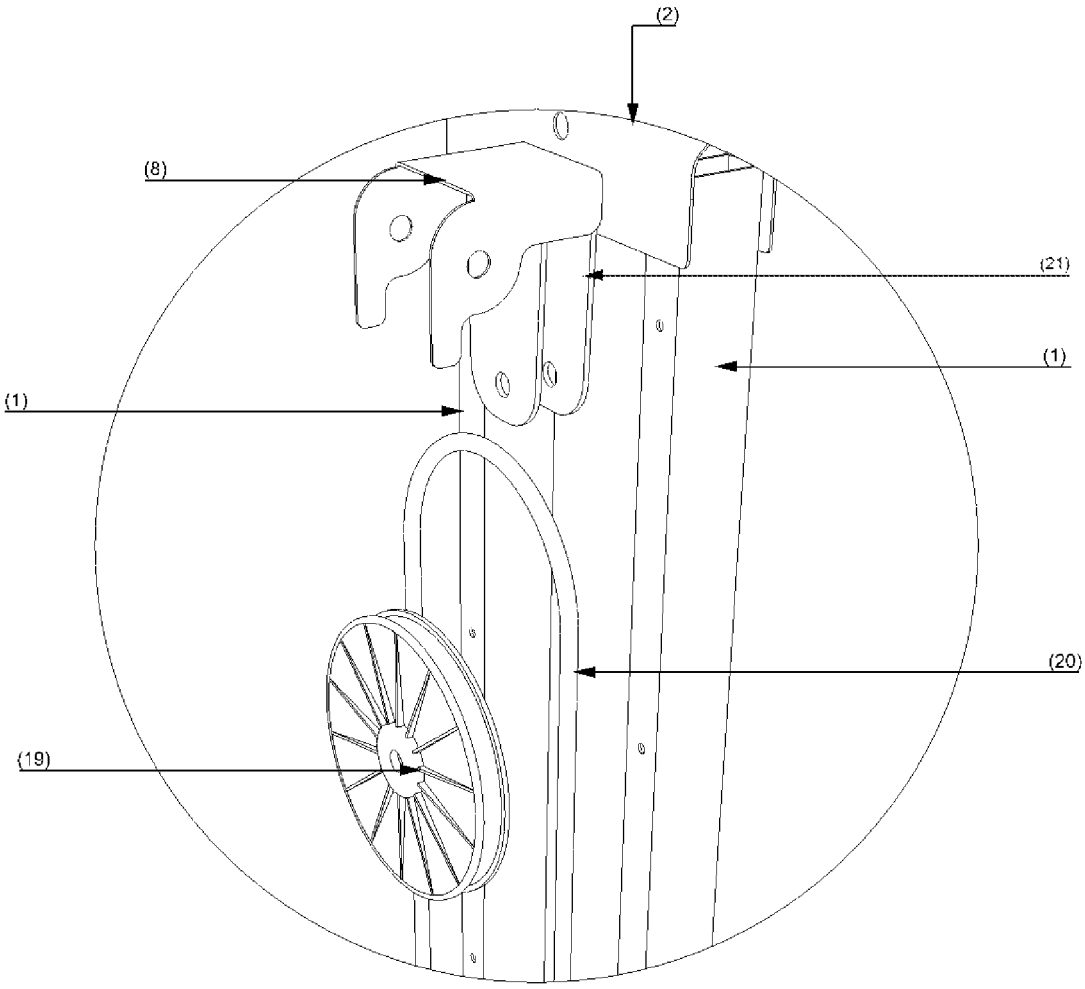
FIG. 7 shows an exploded view of the pulley system of the integral vertical stepper, in which can be seen the proper arrangement of all the parts that integrate this system, which is essential to understand the technical features of said invention.
Figure 8:
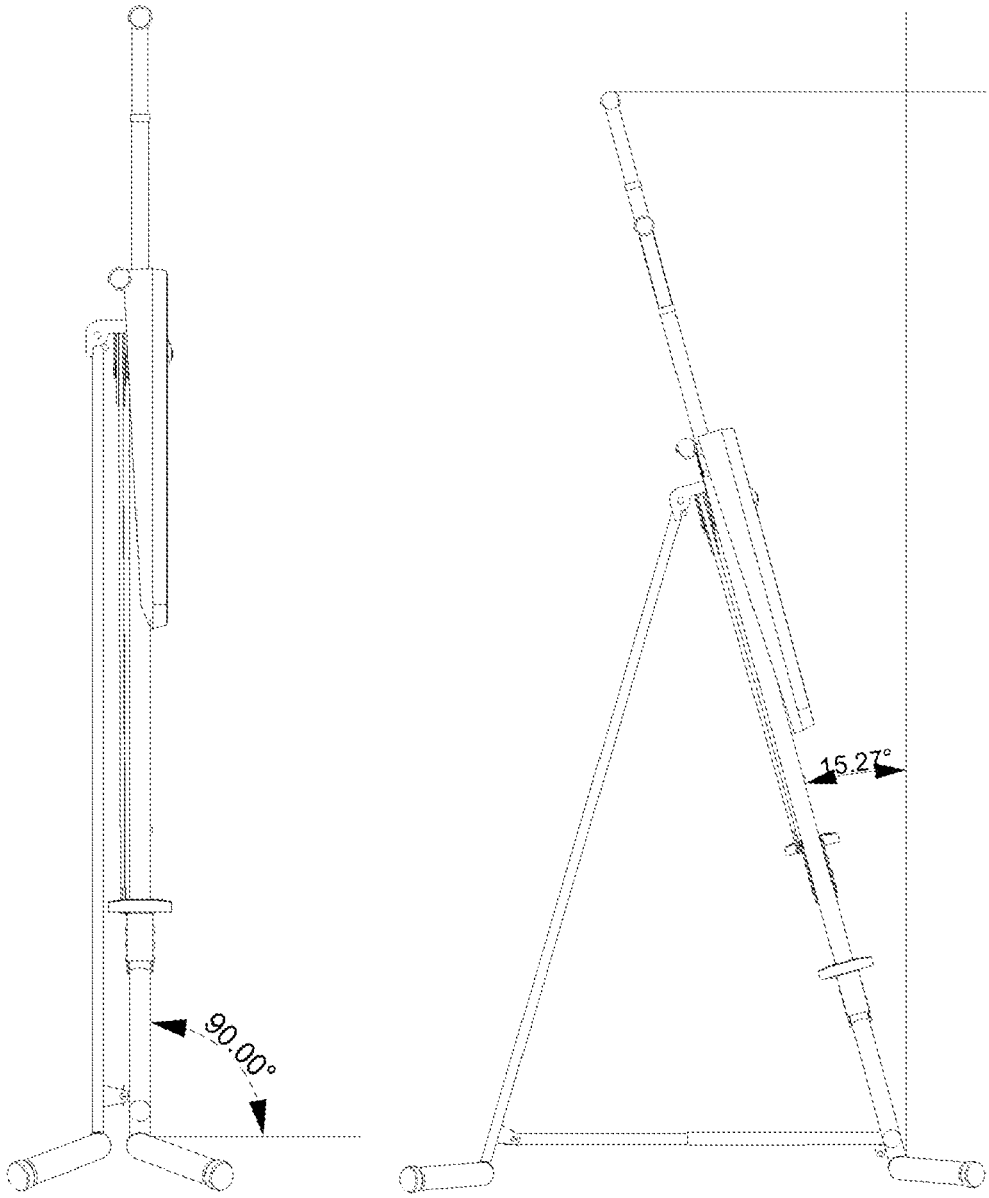
FIG. 8 shows a left side view of the integral vertical stepper expressing the two different positions in which it can be placed.

In light of these figures, it can be seen how the model of integral vertical stepper is constituted by a vertical main structure to which are affixed the majority of the parts, which comprise: two parallel rectangular profiles (1) that function as rails, which are linked together by a bridge (2) at the top, which is welded and designed for accommodate three wheels (3) secured by means of screws acting as guides and allowing the passage of two parallel poles (4) through the top face of the bridge, generating an ascent and descent movement. At the same time, these two rectangular profiles (1) are linked together at their bottom by a concave part welded in each of their bottom faces. In the rear face of the bridge (2), at its upper edge, a horizontal tubular part (5) is welded, in which two handle brackets (6) are assembled, one on each side, which have been provided with protectors (7) to make them more comfortable when holding them. Lastly, in the same rear face of the bridge (2) we find an L-shaped extension (8) that is welded to the bridge (2), which will hold a vertical rectangular profile (9) that will function as an articulated arm, which has welded at the top a small tubular rod that houses an auger attached to the L-shaped extension by screws, and which will be the rotation axis, allowing the free displacement of the vertical rectangular profile (9) and having a top (10) that achieves the proper inclination of the integral vertical stepper so that the exercise can be done in the proper position.

The vertical rectangular profile (9) in its bottom part rests on a concave surface on which is fastened by means of screws a bended tube horizontally placed (11), which will be the rear base of the integral vertical stepper, to which will be coupled in each of its faces a plastic leveler (12) that will allow to maintain the integral vertical stepper stable on any surface where it is placed.

In the front face of the vertical rectangular profile (9) above the concave surface is welded a C-shaped part with triangular faces (13), through which is attached to the center a square profile (14) by means of a turned rod (15) that serves as a lock, since in one of its ends the diameter is greater and in its other end a sphere with spring is contained, which ensures maximum safety, making the integral vertical stepper a 100% safe apparatus.

This square profile (14) fits perfectly within other square profile (16) in whose lower face was welded a round rod (17) attached by means of screws; making the square profile (16) articulated, achieving the union with the parallel rectangular profiles (1).

That is, derived from the combination of the square profile (14) and the square profile (16) a telescopic rod is formed, which when placed at its maximum horizontal length and linked to the C-shaped part with triangular faces (13) will reach the correct position and the appropriate angle in which the integral vertical stepper should be positioned. In turn, and inversely, when the square profile (14) and the square profile (16) are placed at its minimal length in the upright position, it allows the stepper to be folded and to reduce its dimensions, which will allow to place or store it in any space, avoiding obstructions, so these features make it even more attractive for functional use, even in tight spaces.

In the above-described technique, there is a concave part welded at each of their lower sides, to which a bent tube horizontally placed (18) is fastened by means of screws, constituting the front base of the integral vertical stepper; and on each of its faces a plastic leveler (12) will be coupled; this part will share the stability function with the bent tube horizontally placed (11) constituting the rear base of the integral vertical stepper, in order to keep the integral vertical stepper in its correct position on any surface where it is placed.

Describing further the mechanical system of which is comprised the present integral vertical stepper, when referring to its top we find a plastic pulley (19) with diameter between 9.5 and 10.2 cm that has a channel or throat perfectly designed to keep a metal wire coated with a plastic layer (20) in its right position parametrically speaking; also the plastic pulley (19) with diameter between 9.5 and 10.2 cm is structured by a series of grooves radially disposed, constituting a much stronger part, intended to the use for which it was designed. Also, the plastic pulley (19) with diameter between 9.5 and 10.2 cm (19), is manufactured from polyimide (PA), which adds great technical advantages to said mechanical system, due to the physical and mechanical features of said material.

The plastic pulley (19) with diameter between 9.5 and 10.2 cm is affixed by means of screws to a C-shaped part with triangular faces (21) placed at the center, in the interior front side, and attached to the L-shaped extension (8) by means of welding, being located between the two parallel rectangular profiles (1) and the vertical rectangular profile (9); said arrangement allows the travel of the pedals and the ascent and descent movement of the poles in parallel (4) to be adequate when the integral vertical stepper is used.

Expanding the information regarding the use of the metal wire coated with a plastic layer (20) we can mention that it will be responsible for achieving that the pedal system and all component parts that make it up symmetrically, which is composed of: a plastic pedal (22), a pedal base (23) and a set of three wheels (24), being linked by a C-shaped support (25), which will be responsible for joining all the components of the pedal system. In turn, the pedal system is connected by means of an insert with threaded tip that is located on the rear side of the two C-shaped supports (25) to the metal wire coated with a plastic layer (20), by means of two steel connectors (26) placed in each end of the inserts, in order that these elements are adjusted as closely as possible so that all work together and each of the parts forming the pedal system whose function will be support the weight of the user, and therefore causes the tension of the metal wire coated with a plastic layer (20) generating the necessary friction for the plastic pulley (19) with diameter between 9.5 and 10.2 cm works together with all the elements that integrate the mechanical system of the integral vertical stepper.

For a better understanding of the technical features of the pedal system, whose parts were already described in the above paragraph, next will be described the essential part of its displacement operation generated by the right distribution of each of its wheels (24) in each side of the parallel rectangular profiles (1) due that they are arranged in such way that they form an equilateral triangle, and which will be secured to a C-shaped connector (25) by means of screws, allowing each set of wheels (24) to hold each of the parallel rectangular profiles (1), resulting in a smooth and steady displacement on the two parallel rectangular profiles (1) which will function as rails of the integral vertical stepper.

With regard to the rectangular-shaped pedal base (23), which in turn is connected to the part (25) by means of screws, so that it is articulated and can support two plastic pedals (22) placed on each side, which among other features has the power to prevent falls and/or accidents to the operator, because it is designed with textured and non-skid material, manufactured with a non-skid material which together with the proper placement of the integral vertical stepper, provides confidence to the user.

Also, the integral vertical stepper is provided with two square profiles (27) placed on each side; and in each of their upper faces is a tubular piece placed horizontally and used as supports for two handles to which they have been placed two protectors (28) to make them more comfortable when holding them. These two square profiles (27) when attaching to the parallel poles (4) will form a piece with telescopic mechanism, providing five levels of extension, achieving the ideal length and the required high when performing the steady ascent and descent movements in the integral vertical stepper.

When mentioning the pedal system, we can point out that one of its main features is that it consists of a dependent system, specifically we mean that the force exerted by the user will affect inversely and directly proportional to the entire mechanical system of the apparatus, causing all the constituent elements and parts to move uniformly and coordinated, including the two parallel poles (4) along with the two square profiles (27) attached to the part (25) by means of screws, thus achieving that all the elements move vertically together, generating the ascent and descent movement expected, providing stability, support and motor coordination when executing the exercises.

Lastly, and with a purely esthetic intent, the integral vertical stepper includes a plastic casing (29) that comprises a digital clock (30) embedded in its front face, which will be fastened to the apparatus by means of lag screws to the parallel rectangular profiles (1), since they contain the necessary holes for fastening.

The invention claimed is:

1. An integral vertical stepper, comprising:

a main vertical structure comprising two parallel rectangular profiles that are configured to support at least 120 kg and the two parallel rectangular profiles are linked together by a bridge arranged at a top potion thereof;

a vertical rectangular profile;

a first bent tube arranged horizontally to form a front base of the integral vertical stepper, the first bent tube being fixed to a bottom part of the parallel rectangular profiles;

a second bent tube arranged horizontally to form a rear base of the integral vertical stepper, the second bent tube being fixed to a bottom part of the vertical rectangular profile;

a mechanical system;

a pedal system;

a C-shaped part comprising triangular faces arranged on a front face of the vertical rectangular profile, the C-shaped part being attached to a center square profile with a rotatable rod that is configured to lock the integral vertical stepper in an operative configuration and to ensure maximum safety of the integral vertical stepper structure;

a second square profile that houses the square profile to form a telescopic rod;

three wheels housed in the bridge to guide two parallel poles passing through the top face of the bridge with an upwards and downwards movement;

two square profiles each placed on each side of the integral vertical stepper, the two square profiles configured to be coupled to the parallel poles, and to form a telescopic mechanism providing five levels of extension, the telescopic mechanism configured to achieve an ideal length and a required height for a user when performing the upwards and downwards movements associated with the integral vertical stepper;

a tubular part horizontally arranged on each top face of the square profiles and configured as a handle support;

the pedal system comprising two pedal bases and two pedals, each pedal base configured to receive one of the two pedals, two C-shaped supports arranged and configured to each hold one of two pedal based and one of the two pedals of the pedal system;

two sets of three wheels, each arranged on each C-shaped support to engage sides of each one of the two parallel rectangular profiles such that said parallel rectangular profiles act as rails;

the mechanical system comprises a plastic pulley with diameter between 9.5 cm and 10.2 cm, the plastic pulley comprises a channel or throat having a series of grooves radially disposed to hold a metal wire coated with a plastic layer, the mechanical system being fixed such the plastic pulley is connected to a C-shaped part with triangular faces, the C-shaped part arranged in a center in a front inner part of the integral vertical stepper and the plastic pulley being fixed to an L-shaped extension such that the plastic pulley is arranged between the two parallel rectangular profiles and the vertical rectangular profile;

two inserts each having a threaded tip arranged on a rear face of the two C-shaped supports; and two steel connectors placed on each end of the inserts with the threaded tip configured to connect to each pedal on each end of the coated metallic wire such that a weight of the user applied to the pedals generates tension on the coated metal wire to generate movement in conjunction with the plastic pulley together with the mechanical system of the integral vertical stepper, and said mechanical system together with the pedal system is configured as a system, wherein a force exerted by the user on the pedals affects inversely and directly proportional on the mechanical system causing elements and parts of the mechanical system to displace in a uniform and coordinated way, including the two parallel poles along with the two square profiles attached to the C-shaped support.

2. The integral vertical stepper according to claim 1, wherein the stepper comprises a round rod horizontally welded to a lower face of the square profile, and the round rod being connected at its ends with each of the parallel square profiles such that the square profile is configured to be articulated, so that the square profile and the second square profile together form a telescopic rod, which when being placed at its maximum horizontal length and linked to the C-shaped part with triangular faces, reach a correct position and an appropriate angle in which the integral vertical stepper should be positioned, while inversely, when the square profile and the second square profile are at its minimal length in an upright position, the integral vertical stepper can be folded to a 90 degree angle with respect to horizontal, reducing substantially its dimensions and a space the integral vertical stepper occupies.

3. The integral vertical stepper according to claim 1, wherein each set of wheels and the wheels are made of polyamide, and the wheels are arranged in a configuration of equilateral triangle.

4. The integral vertical stepper according to claim 1, further comprising a small tubular rod welded at a top of the vertical rectangular profile, the small tubular rod rotatably attached to the L-shaped extension by an auger housed within the small tubular rod and is fixed to the L-shaped extension to form a rotation axis and is configured to allow a free displacement of the vertical rectangular profile, which is blocked by a top that is configured to restrict a displacement of the vertical rectangular profile, so that the integral vertical stepper has between 15 and 16 degrees of inclination with respect to a vertical, so that exercise can be performed in a proper position.

5. The integral vertical stepper according to claim 1, further comprising plastic levelers that are coupled at ends of the first bent tube and second bent tube to provide stability to the integral vertical stepper.

6. The integral vertical stepper according to claim 1, further comprising protectors disposed on the handle supports.

7. The integral vertical stepper according to claim 1, further comprising a plastic casing with a digital clock in its front face, the plastic casing being fastened to the parallel rectangular profiles.

8. The integral vertical stepper according to claim 1, further comprising a powder coating configured to increase resistance to climatic factors.

9. An integral vertical stepper, comprising:

a main vertical structure comprising two parallel rectangular profiles and the two parallel rectangular profiles are linked together by a bridge arranged at a top portion thereof;

a vertical rectangular profile;

a first tube arranged horizontally to form a front base of the integral vertical stepper, the first tube being fixed to a bottom part of the parallel rectangular profiles;

a second tube arranged horizontally to form a rear base of the integral vertical stepper, the second tube being fixed to a bottom part of the vertical rectangular profile;

a mechanical system;

a pedal system;

a C-shaped part arranged on a from face of the vertical rectangular profile, the C-shaped part being attached to the center square profile with a rotatable rod that is configured to lock the integral vertical stepper profile with a rotatable rod that is configured to lock the integral vertical stepper in an operative configuration and to ensure maximum safety of the integral vertical stepper structure;

a second square profile that houses the square profile to form a telescopic rod;

a plurality of wheels housed in the bridge to guide two parallel poles passing through the top face of the bridge with an upwards and downwards movement;

two square profiles each placed on each side of the integral vertical stepper, the two square profiles configured to be coupled to the parallel poles, and to form a telescopic mechanism providing a plurality of levels of extension, the telescopic mechanism configured to achieve a desired length and height for a user when performing the upwards and downwards movements associated with the integral vertical stepper;

a tubular part horizontally arranged on each top face of the square profiles and configured as a handle support;

the pedal system comprising two pedal bases and two pedals, each pedal base configured to receive one of the two pedals, two C-shaped supports arranged and configured to each hold one of the two pedal bases and one of the two pedals of the pedal system;

two set of wheels, each arranged on each C-shaped support to engage sides of each one of the two parallel rectangular profiles such that said parallel rectangular profile act as rails;

the mechanical system comprises a pulley, and the pulley comprises a channel or throat having a series of grooves radially disposed to hold a wire, the mechanical system being fixed such the pulley is connected to a C-shaped, the C-shaped part arranged in a center in a from inner part of the integral vertical stepper and the pulley being fixed to an L-shaped extension such that the pulley is arranged between the two parallel rectangular profiles and the vertical rectangular profile;

two inserts each having a threaded tip arranged on a rear face of the two C-shaped supports; and two connectors placed on each end of the inserts with the threaded tip configured to connect to each pedal on each end of the wire such that a weight of the user applied to the pedals generates tension on the wire to generate movement in conjunction with the pulley together with the mechanical system of the integral vertical stepper, and said mechanical system together with the pedal system is configured as a system, wherein a force exerted by the user on the pedals affects inversely and directly proportional on the mechanical system causing elements and parts of the mechanical system to displace in a uniform and coordinated way, including the two parallel poles along with the two square profiles attached to the C-shaped support.

10. The integral vertical stepper according to claim 9, wherein the stepper comprises a round rod horizontally welded to a lower face of the square profile, and the round rod being connected at its ends with each of the parallel square profiles such that the square profile is configured to be articulated, so that the square profile and the second square profile together form a telescopic rod, which when being placed at its maximum horizontal length and linked to the C-shaped part, reach a correct position and an appropriate angel in which the integral vertical stepper should be positioned, while inversely, when the square profile and the second square profile are at its minimal length in an upright position, the integral vertical stepper can be folded to a 90 degree angle with respect to horizontal, reducing substantially its dimensions and a space the integral vertical stepper occupies.

11. The integral vertical stepper according to claim 9, wherein each of the wheels are made of polyamide, and the wheels are arranged in a configuration of equilateral triangle.

12. The integral vertical stepper according to claim 9, further comprising a small tubular rod welded at a top of the vertical rectangular profile, the small tubular rod rotatably attached to the L-shaped extension by an auger housed within the small tubular rod and is fixed to the L-shaped extension to form a rotation axis, thus allowing a free displacement of the vertical rectangular profile, which is blocked by a top that is configured to restrict a displacement of the vertical rectangular profile, so that the integral vertical stepper has between 15 and 16 degree of inclination with respect to a vertical, so that exercise can be performed in a proper position.

13. The integral vertical stepper according to claim 9, further comprising levelers that are coupled at ends of the first tube and second tube to provide stability to the integral vertical stepper.

14. The integral vertical stepper according to claim 9, further comprising protectors disposed on the handle supports.

15. The integral vertical stepper according to claim 9, further comprising a casing with a digital clock in its front face, the casing being fastened to the parallel rectangular profiles.

16. The integral vertical stepper according to claim 9, further comprising a powder coating configured to increase resistance to climatic factors.

17. An integral vertical stepper, comprising:

a main vertical structure comprising two parallel rectangular profiles and the two parallel rectangular profiles are linked together by a bridge arranged at a top portion thereof;

a vertical rectangular profile;

a first tube arranged horizontally to form a front base of the integral vertical stepper, the first tube being fixed to a bottom part of the parallel rectangular profiles;

a second tube arranged horizontally to form a rear base of the integral vertical stepper, the second tube being fixed to a bottom part of the vertical rectangular profile;

a mechanical system;

a pedal system;

a C-shaped part arranged on a front face of the vertical rectangular profile, the C-shaped part being attached to the center square profile with a rotatable rod that is configured to lock the integral vertical stepper in an operative configuration and to ensure maximum safety of the integral vertical stepper structure;

a second square profile that houses the square profile to form a telescopic rod;

a plurality of wheels housed in the bridge to guide two parallel poles passing through the top face of the bridge with an upwards and downwards movement;

two square profiles each placed on each side of the integral vertical stepper, the two square profiles configured to be coupled to the parallel poles, and to form a telescopic mechanism providing a plurality of levels of extension, the telescopic mechanism configured to achieve a desired length and height for a user when performing the upwards and downwards movements associated with the integral vertical stepper;

a tubular part horizontally arranged on each top face of the square profiles and configured as a handle support; p1 the pedal system comprising two pedal based and two pedals, each pedal base configured to receive one of the two pedals, two C-shaped supports arranged and configured to each hold one of the two pedal bases and one of the two pedals of the pedal system;

two sets of wheels, each arranged on each C-shaped support to engage sides of each one of the two parallel rectangular profiles such that said parallel rectangular profiles act as rails;

the mechanical system comprises a pulley, and the pulley comprises a channel or throat having a series of grooves radially disposed to hold a wire, the mechanical system being fixed such the pulley is connected to a C-shaped, the C-shaped part arranged in a center in a front inner part of the integral vertical stepper and the pulley being fixed to an L-shaped extension such that the pulley is arranged between the two parallel rectangular profiles and the vertical rectangular profile; and two connectors configured to connect to each pedal on each end of the wire such that a weight of the user applied to the pedals generates tension on the wire to generate movement in conjunction with the pulley together with the mechanical system of the integral vertical stepper, and said mechanical system together with the pedal system is configured as a system, wherein a force exerted by the user on the pedals affects inversely and directly proportional on the mechanical system causing elements and parts of the mechanical system to displace in a uniform and coordinated way, including the two parallel poles along with the two square profiles attached to the C-shaped support.

18. The integral vertical according to claim 17, wherein the stepper comprises a round rod horizontally welded to a lower face of the square profile, and the round rod being connected at its ends with each of the parallel square profiles such that the square profiles is configured to be articulated, so that the square profile and the second square profile together form a telescopic rod, which when being placed at its maximum horizontal length and linked to the C-shaped part, reach a correct position and an appropriate angle in which the integral vertical stepper should be positioned, while inversely, when the square profile and the second square profile are at its minimal length in an upright position, the integral vertical stepper can be folded to a 90 degree angle with respect to horizontal, reducing substantially its dimensions and a space the integral vertical stepper occupies.

19. The integral vertical stepper according to claim 17, wherein each of the wheels are made of polyamide, and the wheels are arranged in a configuration of equilateral triangle.

20. The integral vertical stepper according to claim 17, further comprising a small tubular rod welded at a top of the vertical rectangular profile, the small tubular rod rotatably attached to the L-shaped extension by an auger housed within the small tubular rod and is fixed to the L-shaped extension to form a rotation axis, thus allowing a free displacement of the vertical rectangular profile, which is blocked by a top that is configured to restrict a displacement of the vertical rectangular profile, so that the integral vertical stepper has between 15 and 16 degrees of inclination with respect to a vertical, so that exercise can be performed in a proper position.

* * * * *